US005913753A

United States Patent [19]

Ho

[11] Patent Number: 5,913,753

[45] Date of Patent: Jun. 22, 1999

[54] WEIGHT FOR ATHLETIC TRAINING

[76] Inventor: Chin-Fu Ho, 1F, No. 98, Alley 59, Lane 437, Jeng Hsing Road, Taichung, Taiwan

[21] Appl. No.: 09/030,208

[22] Filed: Feb. 25, 1998

[51] Int. Cl.[6] ..... A63B 21/06

[52] U.S. Cl. ..... 482/105; 482/93

[58] Field of Search ..... 482/93, 105, 108

[56] References Cited

U.S. PATENT DOCUMENTS 4,602,387 7/1986 Zakrzewski ..... 482/105 X 5,484,366 1/1996 Wilkinson ..... 482/105

5,632,709 5/1997 Walsh ..... 482/105

5,709,634 1/1998 Pointer ..... 482/105

*Primary Examiner*—John Mulcahy

*Attorney, Agent, or Firm*—Browdy and Neimark

[57] ABSTRACT

A weight for athletic training is composed of a pliable and tough casing, and a predetermined quantity of metal granules contained in a containing space of the casing. The casing is wrapped by a jacket. A recess in the casing engages a narrow part of the jacket.

2 Claims, 2 Drawing Sheets

WEIGHT FOR ATHLETIC TRAINING

FIELD OF THE INVENTION

The present invention relates generally to a weight, and more particularly to a weight intended for use in the athletic training.

BACKGROUND OF THE INVENTION

The conventional weight for athletic training is generally composed of a long strap having a plurality of pouches for containing the metal weights. Such conventional weight is strapped around the waist or leg for body-building training. The load can be increased or decreased by adding more weights to the pouches or by removing more weights from the pouches. Such a conventional weight as described above is defective in design in that it causes discomfort to the user, and that it can inflict injuries on someone when it falls.

Another conventional weight for athletic training is composed of a sac-like body in which metal granules are held. This kind of the conventional weight does not cause discomfort to the user. However, the weight is fixed and can not be increased or decreased.

SUMMARY OF THE INVENTION

The primary objective of the present invention is to provide an improved weight for athletic training. The improved weight is free from the drawbacks of the conventional weights.

In keeping with the principle of the present invention, the foregoing objective of the present invention is attained by a weight consisting of a pliable and tough casing and a predetermined weight of metal granules. The casing is provided with a space for containing the metal granules.

DETAILED DESCRIPTION OF THE INVENTION

Figure 1:
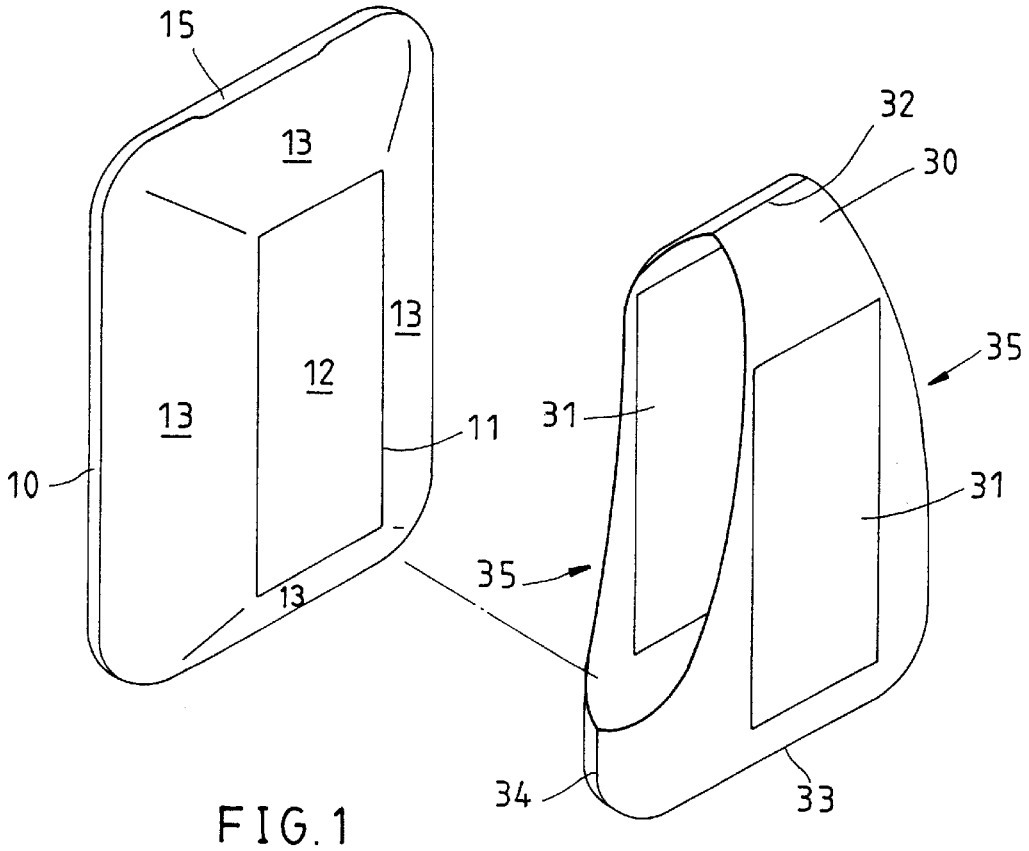
FIG. 1 shows an exploded view of a first preferred embodiment of the present invention.
Figure 2:
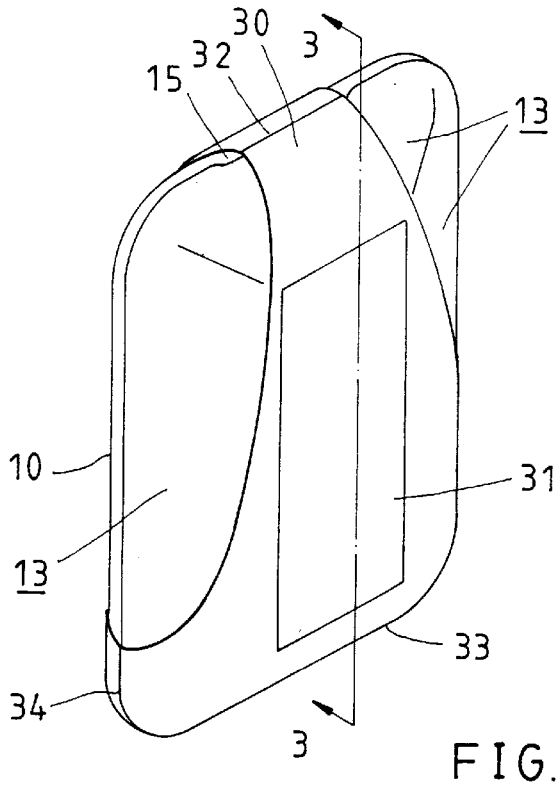
FIG. 2 shows a perspective view of the first preferred embodiment of the present invention in combination.
Figure 3:
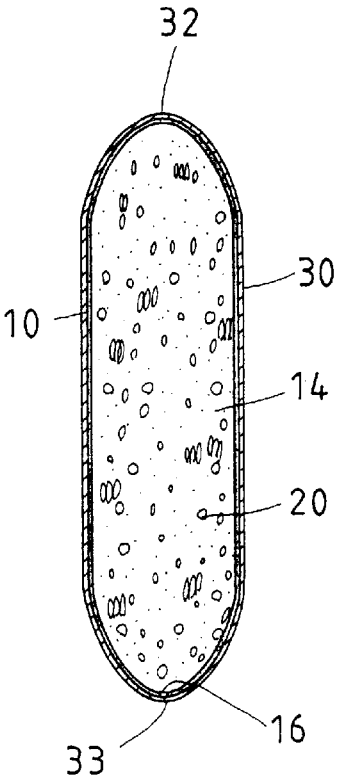
FIG. 3 shows a sectional view of a portion taken in the direction indicated by a line 3—3 as shown in FIG. 2.

As shown in FIGS. 1–3, a weight embodied in the present invention is intended for use in athletic training and composed of a casing 10, a predetermined weight of metal granules 20, and a jacket 30.

The casing 10 has two body pieces 11, which are provided respectively with a planar portion 12 of a rectangular shape. The planar portion 12 is provided respectively in each side thereof with an inclined portion 13 extending therefrom. The two body pieces 11 are joined together such that the peripheries of the inclined portion 13 are fastened end to end without overlapping, and that a containing space 14 is formed by the two body pieces 11 which are made of a pliable and tough plastic material. The casing 10 may be made of a plastic material by injection molding. The casing 10 is provided in the center of the upper end thereof with a recessed portion 15, and in the lower end thereof with a feeding port 16. The metal granules 20 are fed into the containing space 14 of the casing 10 via the feeding port 16. Thereafter, the feeding port 16 is sealed off with tape or other devices such as the ultra sonic wave, the high frequency wave, the thermal welding, etc.

The jacket 30 has two body pieces 31 each having a narrow end 32 and a wide end 33. The two body pieces 31 are joined together such that the narrow end 32 of one body piece 31 is connected with the narrow end 32 of another body piece 31, and that the wide end 33 of one body piece 31 is connected with the wide end 33 of another body piece 31. Both sides of the wide end 33 are connected to form a side end 34. An opening 35 is formed between the side end 34 and the narrow end 32 for inserting the casing 10. The jacket 30 is made of a pliable and tough plastic material and is similar in size to the casing 10. The casing 10 and the jacket 30 may be different in color.

After the casing 10 is filled with the metal granules 20, the feeding port 16 end is inserted into the inside of the wide end 33 of the jacket 30 via the opening 35, the narrow end 32 of the jacket 30 is located in the recessed portion 15. In the meantime, two sides of the casing 10 are confined by the two side ends 34 of the jacket 30. As a result, the casing 10 is securely enclosed by the jacket 30.

Figure 4:
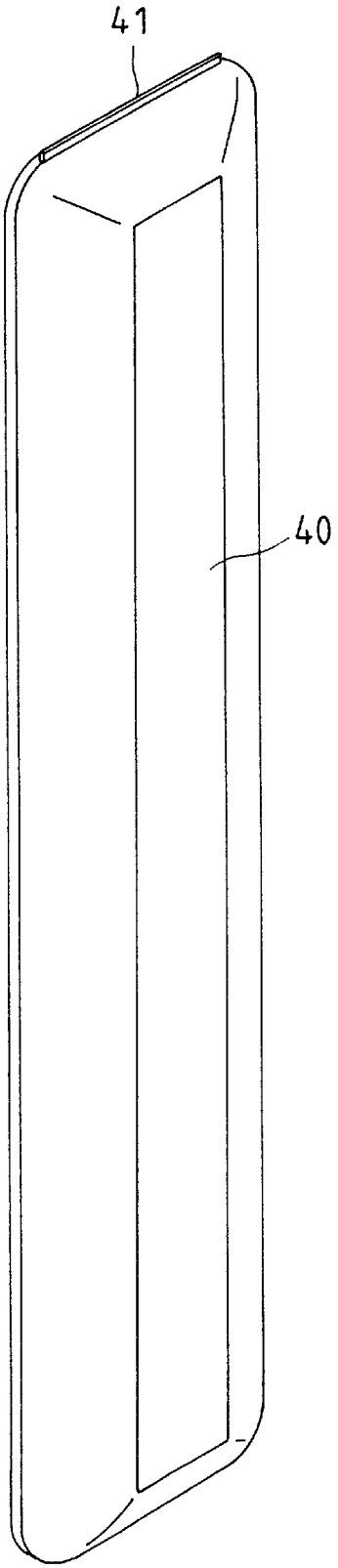
FIG. 4 shows a perspective view of a second preferred embodiment of the present invention.

As shown in FIG. 4, a casing 40 of the second preferred embodiment of the present invention is of a long striplike construction. Upon completion of filling the casing 40 with metal granules, the opening end of the casing 40 is sealed off by the high frequency wave, the ultra sonic wave, the thermal welding, etc. The sealed end is identified by a label 41. The second preferred embodiment of the present invention is devoid of a jacket.

It must be noted here that the present invention may be used independently such that both hands of a user may hold respectively the present invention for doing the athletic training.

What is claimed is:

1. A weight for athletic training, said weight comprising:

a casing made of a pliable and tough plastic material and provided therein with a containing space;

a predetermined weight of metal granules held in said containing space of said casing;

wherein said casing is fitted into a jacket made of a touch plastic material for confining an open end of said casing;

wherein said jacket has two body pieces each having a narrow end and a wide end, with the narrow end of one of said two body pieces being connected with the narrow end of another one of said two body pieces, and with the wide end of one of said two body pieces being connected with the wide end of another one of said two body pieces, said wide ends each having two sides which are connected to form a side end, an opening formed between said side end and said narrow end for inserting said casing into said jacket such that said casing is confined by said wide end, said side end and said narrow end of said jacket;

wherein said casing is provided with a recessed portion corresponding in location to said narrow end of said jacket for locating said narrow end of said jacket; and wherein said open end of said casing is located in an inner side of said wide end of said jacket.

2. The weight as defined in claim 1, wherein said casing has two body pieces each having a planar portion of a rectangular shape, said planar portion provided respectively in four sides thereof with an inclined portion extending therefrom, said two body pieces being joined together such that edges of said inclined portions of said two body pieces are fastened together end to end without overlapping, thereby forming a containing space in said casing, said two body pieces made of a tough and pliable plastic material.

* * * * *